US006237827B1

(12) United States Patent
Reckelhoff

(10) Patent No.: US 6,237,827 B1
(45) **Date of Patent: *May 29, 2001**

(54) STAPLER AND METHOD FOR THE ATTACHMENT OF STEEL FRAMING

(75) Inventor: Jerome E. Reckelhoff, Cincinnati, OH (US)

(73) Assignee: Senco Products, Inc., Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,513

(22) Filed: Nov. 12, 1998

(51) Int. Cl.[7] ..... B25C 1/06

(52) U.S. Cl. ..... 227/8; 227/130; 227/153; 227/155

(58) Field of Search ..... 227/8, 124, 119, 227/139, 153, 130, 131, 155, 152

(56) References Cited

U.S. PATENT DOCUMENTS

| | | | | |
|---|---|---|---|---|
| 2,086,922 | * | 7/1937 | Peterson | 227/119 |
| 2,772,415 | * | 12/1956 | Jenny | 227/124 |
| 2,853,707 | * | 9/1958 | Juilfs | 227/139 |
| 2,943,327 | * | 7/1960 | Juilfs | 227/124 |
| 3,252,641 | * | 5/1966 | Ciechanowski | 227/8 |
| 3,734,378 | * | 5/1973 | Rice et al. | 227/124 |
| 3,786,978 | * | 1/1974 | Manganaro | 227/131 |
| 3,900,144 | * | 8/1975 | Hamilton | 227/155 |
| 4,227,638 | * | 10/1980 | Medina et al. | 227/155 |
| 4,315,589 | * | 2/1982 | Soong | 227/155 |
| 4,366,924 | * | 1/1983 | Leiter | 227/131 |
| 4,572,419 | * | 2/1986 | Klaus et al. | 227/8 |
| 4,573,625 | * | 3/1986 | Olesen et al. | 227/131 |
| 4,574,992 | * | 3/1986 | Holman | 227/130 |
| 4,726,504 | * | 2/1988 | Halbert | 227/8 |
| 5,873,509 | * | 2/1999 | Liao | 227/119 |

* cited by examiner

*Primary Examiner*—Scott A. Smith
(74) *Attorney, Agent, or Firm*—Frost Brown Todd LLC

(57) ABSTRACT

A staple driving tool and a method for clamping and stapling together two or more steel workpiece layers as in light gauge steel framing for residential and commercial buildings, truss assembly, and the like. The stapling tool has a guide body and a jaw assembly supporting an anvil. The jaw assembly is pivoted to a mounting bar extending along and beneath the tool magazine. The jaw is pivotable between a normal open position and a closed position wherein it clamps the steel workpiece layers to be joined between the anvil and the guide body prior to stapling. The jaw is pivotable by an air cylinder actuated toggle mechanism. An air valve normally connects the air cylinder to atmosphere. When actuated, the air valve connects the air cylinder to a source of pressurized air, shifting the jaw to clamping position. The air valve may be actuated by one of the tool safety and the tool trigger. Thereafter, the tool operator may release the trigger or safety to reposition the tool, or the operator may complete actuation of the trigger to drive a staple through the clamped steel layers, causing the anvil the clinch the staple against the steel layers. As the staple approaches the steel layers to be joined, a member enters between the staple legs to prevent buckling thereof until the staple penetrates the steel layers, whereafter the member is shifted by the staple crown and driver from between the legs to accommodate the staple crown and driver.

15 Claims, 8 Drawing Sheets

STAPLER AND METHOD FOR THE ATTACHMENT OF STEEL FRAMING

TECHNICAL FIELD

The invention relates to a staple driving tool and a method of use thereof, and more particularly to such a tool and method wherein the tool is used to clamp together at least two workpieces of relatively light gage metal and to hold the workpieces in place during the driving of a staple therethrough.

BACKGROUND ART

While not intended to be so limited, the tool and method of the present invention are particularly well adapted for use in light gage steel framing for residential and commercial buildings. An example of another use for the tool and method of the present invention is the assembly of trusses and the like.

Today, most light gauge steel framing for residential and commercial buildings is done with an electric screw driving tool using self-drilling and tapping screws. The parts to be joined together are manually held in place while the screw is driven. Screws are easily dropped and lost. The use of the tool and method of the present invention provides a more flush surface on which to apply dry wall. The method of the present invention is easier than the use of self-tapping screws and is less time consuming. The staple driving tool clamps the metal framing members together prior to stapling and, if necessary, this clamping can be readjusted prior to stapling. Staples are cheaper than screws and are self contained in strips or "sticks". Thus, staple loss and waste is much lower than with screws. The staple driving tool is provided with a safety and the clamping mechanism is actuated either by the safety or by the manual trigger of the tool.

As indicated above, in the typical prior art light gauge steel framing techniques employed, the individually hand driven self-tapping, screws are driven with the aid of an electric screw driver. This approach is time consuming. Pneumatically driven steel framing pins have also been used, but it has been found that pins generally do not perform as well as screws in cyclic loading conditions. The present invention will allow for forced entry fastener installation using electric or pneumatic tools, not effected by vibration or cyclic loading to the extent that typical forced entry framing pins are. Another advantage of the present invention is the reduction in cost of assembly when using light gauge steel framing members.

The pivotal clamping jaw, the link, the toggle elements and the air cylinder of the present invention, to be described hereinafter, are affixed to a mounting bar which extends along and beneath the tool magazine. This assembly may be applied (with minor modification) to a number of existing staple driving tools. In FIG. 1 to be discussed hereinafter, this mechanism is shown affixed to a staple driving tool manufactured by Senco Corporation of Cincinnati, Ohio and sold under the designation SNS-45.

DISCLOSURE OF THE INVENTION

According to the invention there is provided a staple driving tool and a method for clamping and thereafter stapling together two or more light gauge steel workpiece layers as in light gauge steel framing for residential and commercial buildings. The stapling tool has a handle portion, a main body portion and a guide body, together with a staple containing magazine. The tool is further provided with a jaw assembly supporting an anvil. The jaw assembly is pivoted to a mounting bar extending along and beneath the tool magazine. The jaw is pivotable between a normal open position and a closed position wherein it clamps the steel layers to be joined between the anvil and the guide body prior to stapling. The jaw is shifted between open and clamping positions by an air cylinder actuated toggle mechanism. The air cylinder, in turn, is operated by an air valve mounted on the tool.

The air valve is actuated by either the tool safety or the tool trigger. This actuation causes the workpieces to be clamped together. The tool operator may release the trigger or safety to reposition the workpieces, or the operator may complete operation of the trigger to drive a staple through the clamped steel layers. The anvil, supported by the jaw, causes the staple to be clinched against the steel layers being joined. The staple driving tool may also be provided with a member which is located between the staple legs as the staple approaches the steel layers to be joined. The member cooperates with the drive track of the guide body to prevent buckling the staple legs as they penetrate the steel layers. Thereafter, the member is shifted from between the legs by the staple crown and the driver, enabling the staple to be fully clinched.

DETAILED DESCRIPTION OF THE INVENTION

Figure 1:
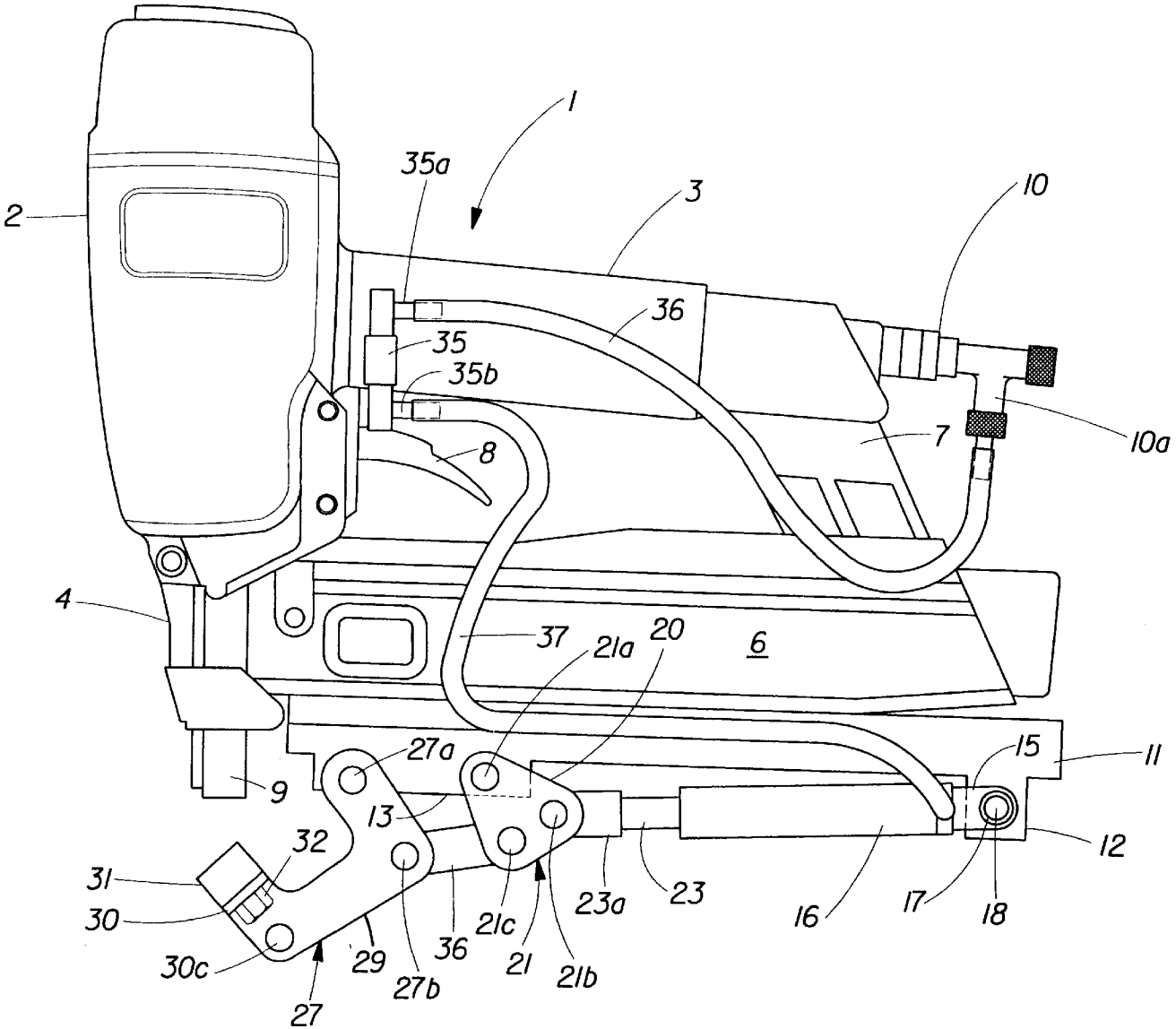
FIG. 1 is a side elevational view of a stapler provided with the anvil, jaw and toggle mechanism of the present invention.

Reference is first made to FIG. 1, which illustrates an exemplary pneumatic stapler provided with the clamping and staple forming mechanism of the present invention. The stapler is generally indicated at 1 and comprises a main body portion 2 and a handle portion 3. Beneath the main body portion there is a guide body 4 providing a drive track 5 for the staples (see FIGS. 9–11). The staples may be joined together by adhesive means, tape, wire or the like into "sticks" of staples, as is well known in the art. A stick of staples is insertable in the magazine 6 of the stapler 1. The forward end of the magazine is mounted on the guide body 4 and is connected to the drive track 5, in the usual manner. The rearward end of the magazine is supported by an extension 7, which depends downwardly from handle 3.

As is well known in the art, the main body portion 2 of stapler 1 contains a cylinder (not shown) with a piston (not shown) to which a staple driver (not shown) is affixed. The lowermost end of the staple driver is normally engaged in the uppermost portion of the drive track 5 of guide body 4. The cylinder is surmounted by a main valve (not shown) which, when open, allows pressurized air to enter the cylinder and drive the piston and driver downwardly, causing the staple to pierce the metal pieces to be joined and to be clinched against the metal pieces by virtue of the anvil depression. The main valve is opened by a remote valve (not shown) actuated by a manual trigger 8, as is well known in the art. The tool I may be provided with a safety, a portion of which is shown at 9. The safety, when pressed against the workpieces to be joined, enables the operator to actuate trigger 8. Such safeties are well known in the art. The rearward end of handle portion 3 is provided with a fitting 10 which may be a quick connect/disconnect fitting for an air hose (not shown) from a source of pressurized air (not shown). By virtue of this connection, portions of the main body 2 and the handle 3 constitute a reservoir for pressurized air, again as is well known in the art.

Reference is now made to FIGS. 2–6 wherein the anvil and clamping mechanism of the present invention is most clearly shown. The mechanism comprises a mounting bar 11 affixed to the bottom of magazine 6, and extending substantially the length thereof. The mounting bar 11 has a rearward downwardly depending extension 12 and a somewhat larger forward downwardly depending extension 13. Extension 12 is adapted to be flanked by bifurcations 14 and 15 affixed to the rearward end of an air cylinder 16. Extension 12 and bifurcations 14 and 15 are provided with coaxial bores (one of which is shown at 17). These bores are intended to receive a pivot member 18 by which bifurcations 14 and 15 are pivotally affixed to extension 12. Pivot member 17, and other pivot members to be described hereinafter can be of any appropriate type including pivot pins, bolts, roll pins, headed pins with a nut or cotter pin at the free end thereof, or the like.

The rearward portion of extension 13 is adapted to support a pair of identical toggle elements 19 and 20 comprising a toggle assembly generally indicated at 21. To this end, toggle elements 19 and 20 and the extension 13 are provided with coaxial holes (one of which is shown at 22) adapted to receive a pivot member 21*a* so that toggle elements 19 and 20 are pivotally mounted with respect to extension 13.

Cylinder 16 has a piston rod 23 terminating in a portion 23*a* just nicely received between toggle elements 19 and 20. Toggle elements 19 and 20, together with piston rod portion 23*a* are provided with coaxial bores (one of which is shown at 25) so that they may be pivoted together by means of a pivot member 21*b*.

The jaw assembly of the clamping mechanism is generally indicated at 27 and comprises two substantially L-shaped jaw members 28 and 29. As is perhaps best shown in FIG. 2, the upright leg 29*a* (as viewed in that Figure) terminates in a rounded end 29*b*. The substantially horizontal leg 29*c* terminates in a substantially horizontal surface 29*d* (as viewed in FIG. 2). It will be appreciated that jaw member 28 is identical to jaw member 29 and is of the same peripheral configuration, with an upright leg 28*a* with a rounded end 28*b*, a substantially horizontal leg 28*c* with a substantially horizontal surface 28*d*.

Figure 2:
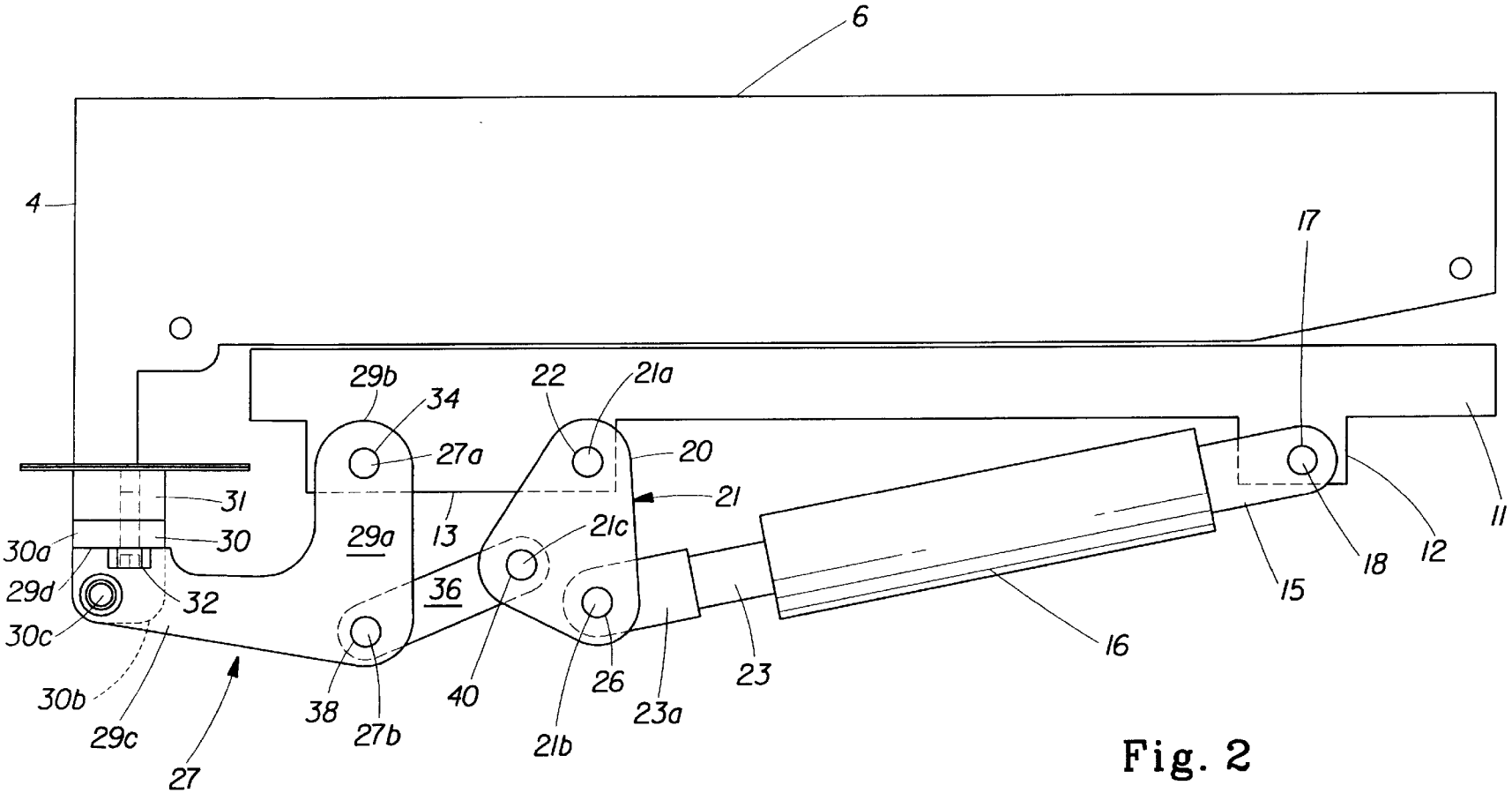
FIG. 2 is a side elevational view of the anvil, jaw and toggle mechanism in closed position and affixed to the stapler magazine.
Figure 3:
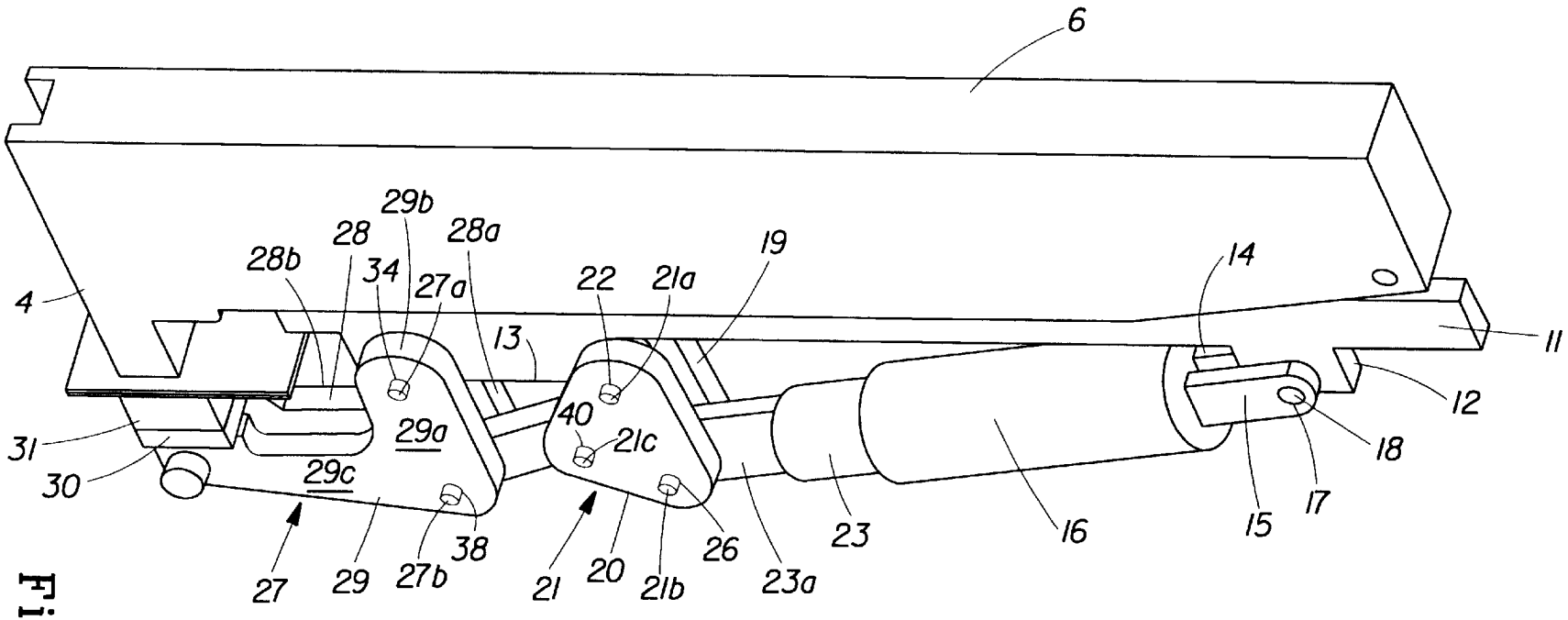
FIG. 3 is a top, left side, rear end prospective view of the magazine, anvil, jaw and toggle mechanism.
Figure 4:
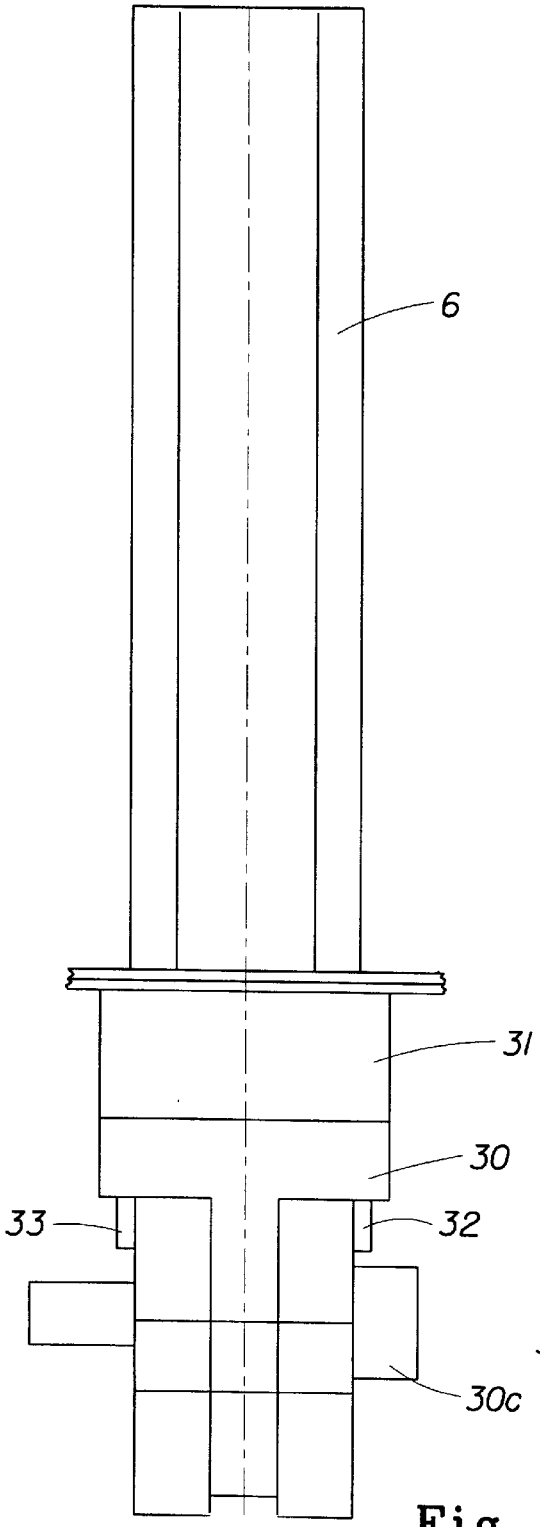
FIG. 4 is a front elevational view of the mechanism of FIGS. 2 and 3.
Figure 5:
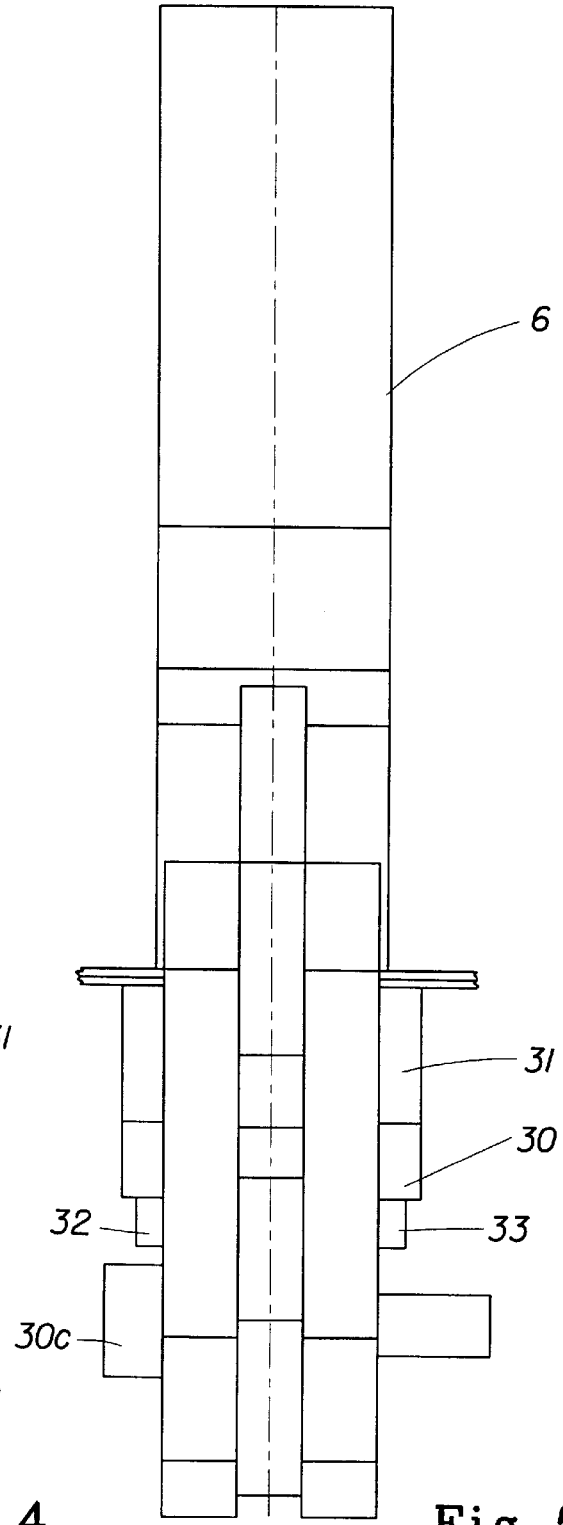
FIG. 5 is a rear elevational view of the assembly of FIGS. 2 and 3, without the air cylinder.

A T-shaped anvil support is shown at 30. The upper portion 30*a* of the T-shaped anvil support 30 rests upon the horizontal end surfaces 28*d* and 29*d* of L-shaped members 28 and 29 as is shown in FIGS. 2 and 4. The anvil and clamping member 31 is a block like member which rests upon the top surface of support 30 and is bolted thereto by a pair of bolts, one of which is shown at 32 in FIG. 2, and the other of which is shown at 33 in FIGS. 4 and 5. The support 30 has a downwardly depending central portion 30*b* which is just nicely received between the ends of jaw elements 28 and 29 and is affixed therebetween by pin or bolt 30*c*. The horizontal surfaces 28*d* and 29*d* prevent rocking of support 30 and thus of anvil and clamp member 31.

Figure 6:
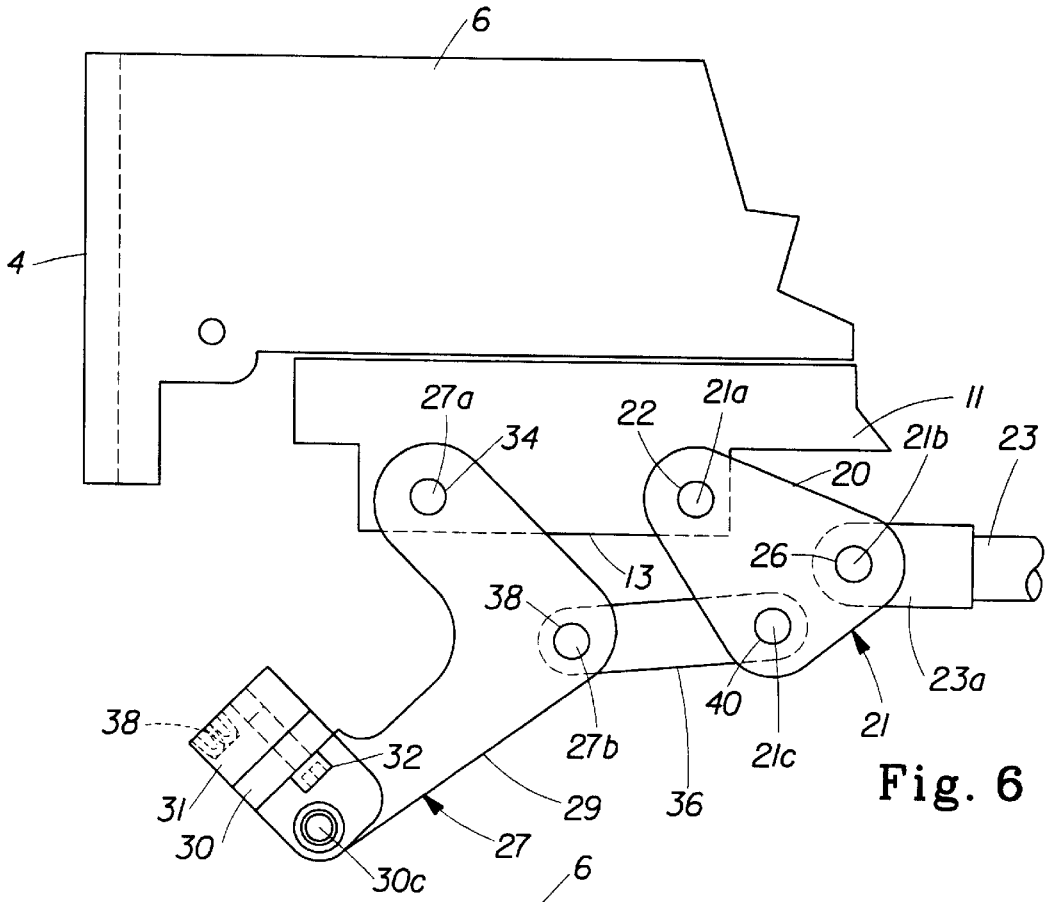
FIG. 6 is a fragmentary side elevational view of the magazine, guide body, and the anvil, jaw and toggle mechanism of the present invention in open condition.
Figure 7:
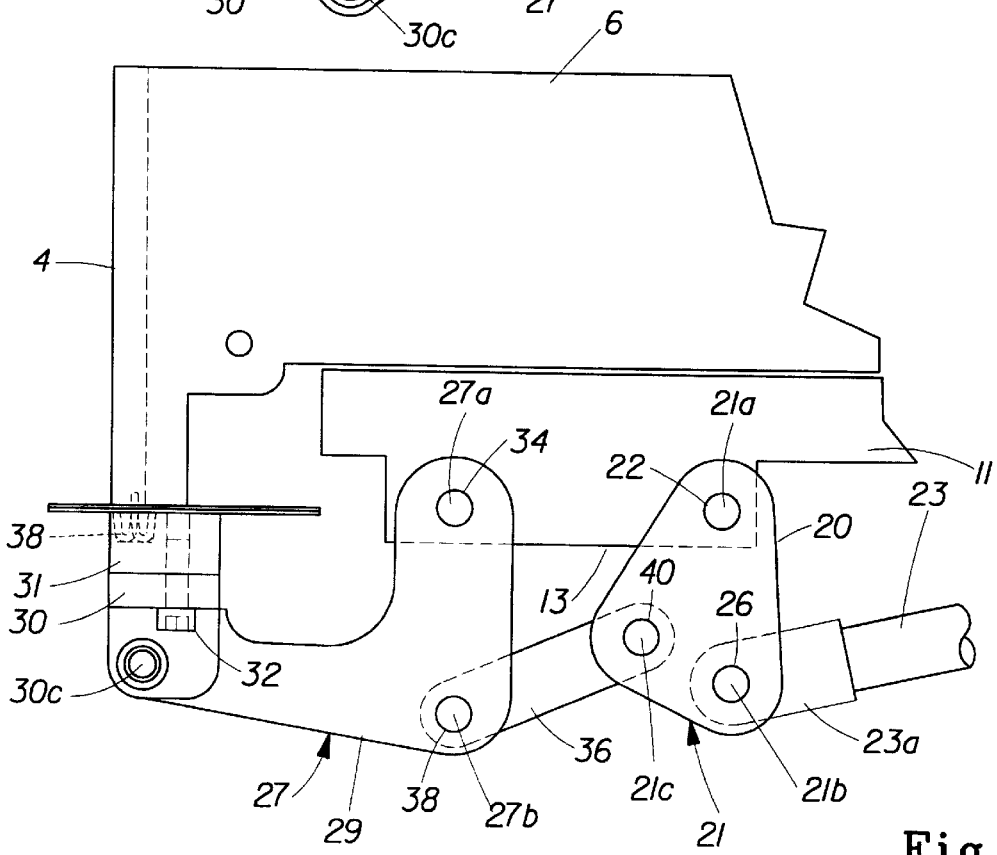
FIG. 7 is a fragmentary side elevational view illustrating the elements of FIG. 6 in closed position, clamping a pair of workpieces.

The upper rounded ends 28*b* and 29*b* of the upright legs 28*a* and 29*a* lie to either side of the forward portion of extension 13. Coaxial bores (one of which is shown at 34) are formed in the leg ends and the forward portion of extension 13 for receipt of a pivot member 27*a*. As a consequence, the jaw assembly 27 is rockable about pivot member 27*a* between an unclamping position and a clamping position. Finally, the juncture between legs 28*a* and 28*c* and legs 29*a* and 29*c* have extending therebetween a link 36. The link is pivoted to jaw elements 28 and 29 by pivot member 27*b* passing through coaxial bores in these elements (one of which is shown at 38). The overall clamping assembly is completed by pivotally attaching the other end of link 36 to toggle elements 19 and 20 by means of a pivot member 21*c* passing through coaxial bores (one of which is shown at 40 in FIG. 3) located in toggle elements 19 and 20 and the adjacent end of link 36. As will be clear from FIGS. 1, 2, 3, 6 and 7, when pressurized air is introduced in to the cylinder 16 to cause piston rod 23 to be extended, the overall jaw assembly 27 will clamp a pair of steel workpieces between the anvil 31 and guide body 4 as shown in FIG. 7. When cylinder 16 is vented to atmosphere, the piston rod 23 will be retracted by virtue of a compression spring (not shown) within air cylinder 16, and the jaw assembly 27 will return to its normal open position as shown in FIG. 6. Referring to FIG. 1, the tool 1 is provided with an air valve 35. Air valve 35 has an inlet 35*a* connected by a tube 36 to a branch 10*a* of quick connect/disconnect fitting 10. Thus, the tube 36 and branch 10*a* are capable of connecting valve 35 to the source of pressurized air (not shown).

Air valve 35 has an outlet port 35*b* connected by tube 37 to the rearward end of piston 16.

When air valve 35 is in its normal, unactuated state, it connects tube 37 and the interior of piston 16 to atmosphere. At the same time, it closes inlet port 35*a* from the source of pressurized air. When the cylinder 16 is connected to atmosphere, the compression spring (not shown) therein will cause piston 23 to retract shifting toggle assembly 21 and link 36 in such a way that the jaw assembly 27 will be in its normal, open position. When air valve 35 is actuated, inlet port 35*a* will be open so that the valve receives air under pressure from the source thereof. The outlet port 35*b* of air valve 35 will be closed from atmosphere and open to tube 37, allowing the pressurized air to actuate cylinder 36, causing piston 23 to shift forwardly against the action of the compression spring (not shown) within cylinder 16. This, in turn, via toggle assembly 21 and link 36 will cause the jaw assembly 27 to assume its clamping position, clamping two or more metallic workpieces together to be stapled.

Air valve 35 may be actuated either by safety 9 or manual trigger 8. When air valve 35 is actuated by safety 9, the operator of tool 1 arranges the pieces to be joined and then presses the bottom end of guide body 4 against the workpieces, shifting safety 9 to its actuated position. This immediately actuates air valve 35 causing the workpieces to be clamped by the jaw assembly 29 against the bottom end of guide body 4. Shifting safety 9 also enables trigger 8. The safety having shifted to its actuated position, the operator can now actuate manual trigger 8 driving and clinching a staple through the workpieces to join them together.

When the manual trigger 8 is used to actuate air valve 35, the operator of tool 1 will arrange the workpieces in position to be stapled and will bring the bottom end of guide body 4 to bear against the workpieces shifting safety 9 to its actuated position enabling manual trigger 8. Manual trigger 8 will be operatively connected to valve 35 by a lateral extension or the like (not shown). Initial squeezing of the trigger will activate valve 35 causing the workpieces to be clamped by jaw 27 against the bottom end of guide body 4. Further squeezing of the trigger will drive a staple through the workpieces and clinch the staple legs.

When both clamping and staple driving are accomplished by the manual trigger, the tool operator can first clamp the workpieces by partial actuation of trigger 8. If the alignment of the workpieces to be joined is not correct, the operator can release the trigger and thus unclamp the workpieces. Thereafter the operator can realign the workpieces and re-clamp them. If satisfied with their alignment, the operator can fully actuate the trigger and staple the workpieces together.

Figure 8:
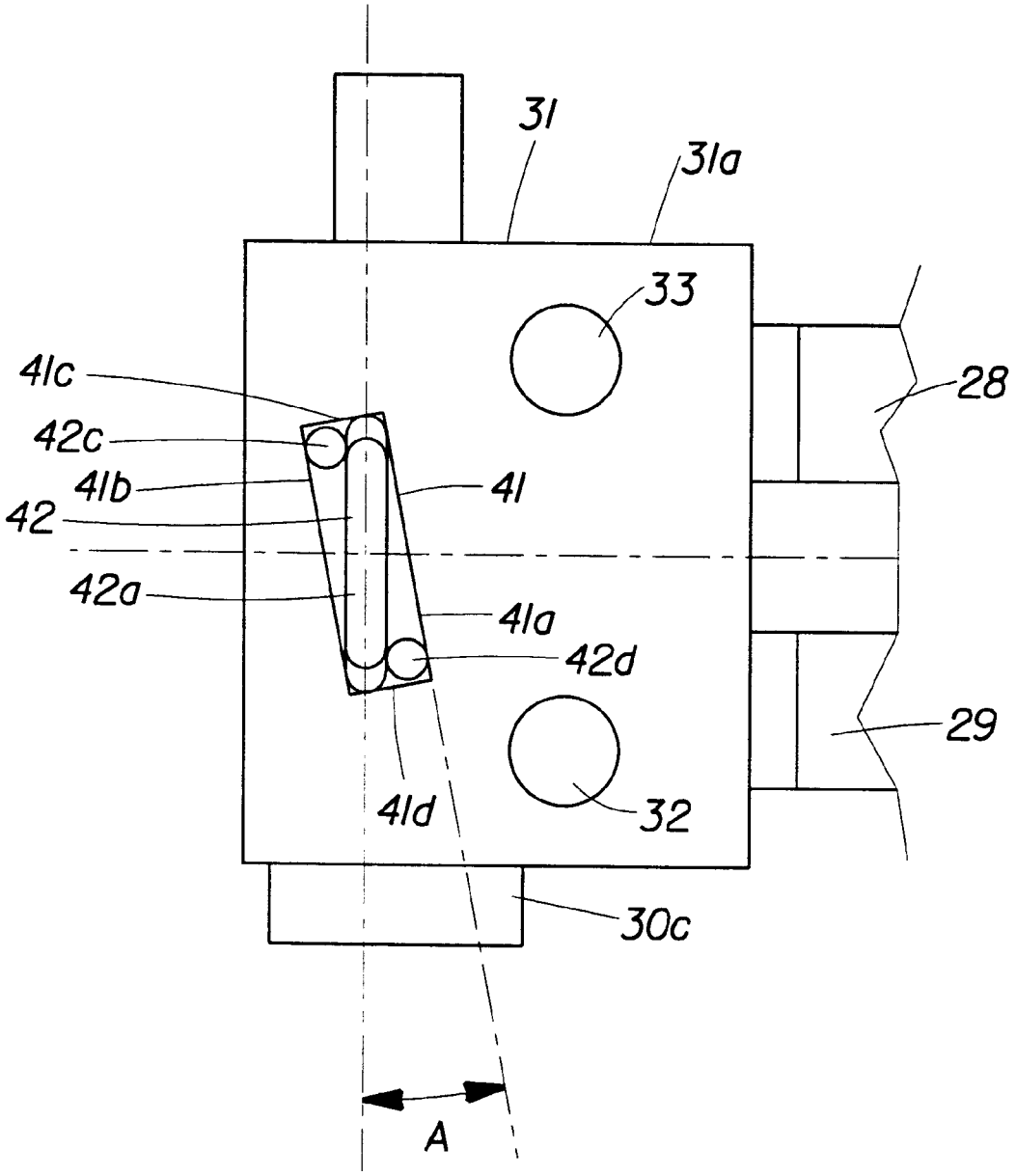
FIG. 8 is a plan view of the anvil and its staple forming depression.

Reference is now made to FIG. 8 wherein the anvil 31 is shown in plan. The anvil 31 has a top surface 31 a as viewed in FIG. 8. This top surface is provided with a rectangular recessed pocket 41 having sides 41*a* and 41*b* and ends 41*c* and 41*d*. Pocket 41 has a curved bottom extending from end 41*c* to end 41*d*. The curved bottom is configured to redirect the free ends of the staple legs in a curvilinear fashion back against the workpieces being joined. The sides 41*a* and 41*b* extend downwardly and are perpendicular to top surface 31*a*. In FIG. 8, a staple 42 is shown having a crown portion 42*a* and legs 42*b* and 42*c*.

It will be noted that the pocket 41 is skewed with respect to the surface 31*a* in which it is formed. The axis of the staple crown 42*a* is parallel to the forward and rearward edges of surface 31*a*. The sides 41*a* and 41*b* of pocket 41 lie at an angle A of about 30 degrees to the staple crown axis. This angularity can have a range of from about 10 degrees to about 30 degrees depending upon the size and gauge of the staple being used. As is clear from FIG. 8, this skewing of pocket 41 causes the staple legs to be formed at an angle to the staple crown and substantially parallel to each other. Therefore, during clinching, the staple legs 42*c* and 42*d* do not interfere with each other or with the staple crown. It would be within the scope of the invention to provide the anvil with two pockets, one for each staple leg, to accomplish the same result.

Figure 9:
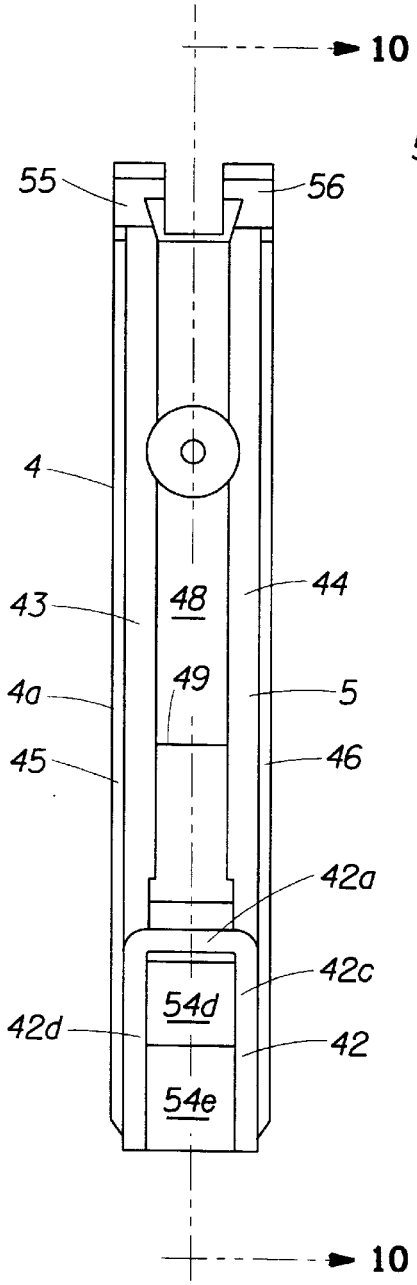
FIG. 9 is an elevational interior view of the forward portion of the guide body and drive track therein.

It will be noted from FIG. 9, for example, that the staples 42 of the present invention have a relatively short crown with legs which are greater in length than the crown. A "narrow crowned staple" (i.e. a staple with a relatively short crown) is advantageous in that it improves penetration in the metal workpieces without buckling.

Figure 10:
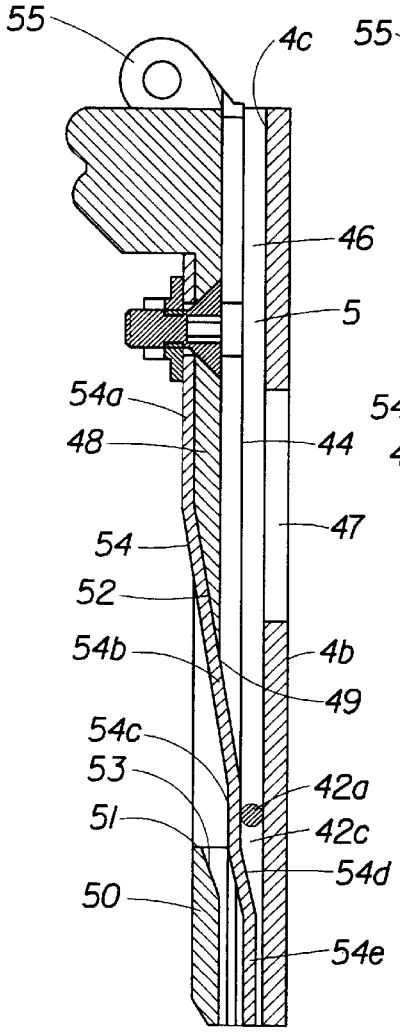
FIG. 10 is a cross-sectional view taken along section line 10—10 of FIG. 9, and illustrating the leaf spring of the guide body in its innermost position.
Figure 11:
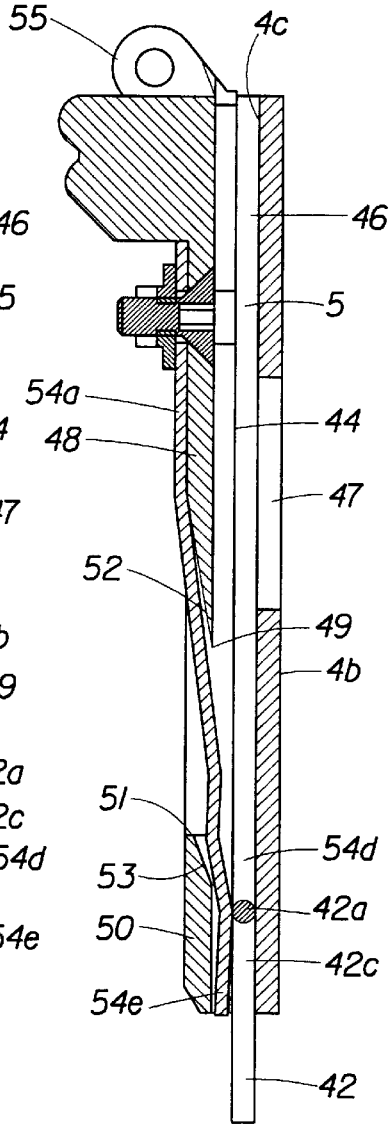
FIG. 11 is a cross-sectional view similar to FIG. 10, but illustrating the leaf spring in its forwardmost position.

Reference is made to FIGS. 9, 10 and 11. FIG. 9 is an interior view of the forward portion 4*a* of guide body 4. The forward portion 4*a* has a pair of parallel, spaced vertical surfaces 43 and 44, which constitute the forward surfaces of guide track 5. Edge elements 45 and 46 serve as the sides of drive track 5. Drive track 5 is completed by the rear portion 4*b* of guide body 4 (see FIG. 10) which provides the rear surface 4*c* of the drive track 5. Drive track 5 is adapted to receive the driving end of the tool driver (not shown). When the driver is in its retracted position, its lower end will be in the uppermost part of drive track 5. When the driver is in its normal retracted position, the forwardmost staple of the stick of staples in magazine 6 is urged forwardly by a staple advancing mechanism (not shown) through an opening 47 in rear portion 4*b* of drive track 4 into drive track 5. Thus, when the driver is retracted at the end of a cycle, the staple advancing mechanism will locate the next forwardmost staple of the stick in the drive track so that the next driving cycle can be initiated when desired.

It will be noted that the forward surfaces 43 and 44 of drive track 5 are joined by a recessed wall 48, which extends downwardly from the top of forward portion 4*a* and ends at 49. As is clear from FIG. 10, a similar recessed wall 50 has an upper end 51 spaced from the end 49 of wall 48 and a lower end 52 at the bottom of the guide body 4. The wall 48 has a downwardly and inwardly sloping portion 52. The wall 50 also has downwardly and inwardly sloping portion 53. The reasons for the sloping portions will be apparent hereinafter.

As is best shown in FIG. 10, the forward portion 4*a* of guide body 4 has mounted thereon a leaf spring 54. Leaf spring 54, as viewed in FIG. 10, has a first vertical portion 54*a* which is attached and lies along the outside vertical surface of wall portion 48 of the front portion 4*a* of guide body 4. Leaf spring 54 has a second portion 54*b* which lies along the downwardly and inwardly sloped portion 52 of wall 48 The leaf spring portion 54*b* extends through the opening defined by the bottom edge 49 of wall 48 and the top edge 51 of wall 50. Leaf spring portion 54*c* terminates in a vertical portion 54*c*, the inside surface of which is substantially coplanar with the wall surfaces 43 and 44 (see FIG. 9). Leaf spring portion 54*c* terminates in downwardly and inwardly sloping spring portion 54*d*. The leaf spring portion 54*d*, in turn, terminates in a vertical portion 54*e* which is substantially parallel to the rear drive track surface 4*c* defined by rearward guide body portion 4*b* (see FIG. 10). The portion 54*e* is located near this rear drive track surface 4*c*, as is shown in FIG. 10.

When a staple 42 enters the drive track 5 through opening 45, and is driven downwardly by the tool driver (not shown), the staple 42 will be confined by side members 45 and 46, forward surfaces 43 and 44 and rearward surface 4*c* making up drive track 5. When the staple 42 reaches a point where its legs 42*c* and 42*d* are at the bottom of the drive track 5 and in contact with the steel layers to be stapled, it will be noted that the crown 42*a* of the staple 42 will be located between the rear drive track surface 4*c*, the front drive track surfaces 43 and 44 and the portion 54*c* of leaf spring 53. Meanwhile, the leaf spring portion 54*e* is located between the legs 42*c* and 42*d* of the staple 42. As a result of this, when the staple 42 begins to penetrate the steel layers, the legs 42*c* and 42*d* will be prevented from buckling forwardly by front wall portions 43 and 44, rearwardly by rear wall 4*c*, laterally outwardly by side wall portions 45 and 46 and laterally inwardly by leaf spring portion 54*e*.

Once the staple legs 42*c* and 42*d* have penetrated the steel layers, the crown of the staple will ride along downwardly and inwardly sloped leaf spring portion 54*d*, causing the bottom part of the leaf spring to shift to the left as viewed in FIG. 10 to the position shown in FIG. 11. While the leaf spring portion 54*e* is no longer between the legs of the staple, it is no longer needed for this purpose since the legs have already penetrated the steel's layers. The driver will drive the staple out of drive track 5, the bottommost part of the driver passing between rear drive track wall 4*c* and the lower portion 54*e* of leaf spring 54. At the end of the driving cycle, the driver will retract to its normal position, and the leaf spring 54 will return to its normal position shown in FIG. 10.

The forward portion 4*a* of guide body 4 may be provided with a pair of parallel spaced bifurcations 55 and 56 (see FIG. 9) by which it is pivoted to the main body portion 2 of tool 1. In this manner, the forward guide body portion 4*a* serves as an openable gate to the drive track 5 should a staple become jammed in the drive track. The provision of an openable gate is well known in the art. It will be understood that the gate will be provided with some form of latch mechanism (not shown) to keep it closed during operation of the tool, again as is well known in the art.

It will be understood by one skilled in the art that a non-flexible metal piece could be positioned between the staple legs by a resilient member which would enable the staple crown and driver to move the non-flexible piece out of the drive track during the final portion of the drive. Such a structure is shown in FIG. 12.

Figure 12:
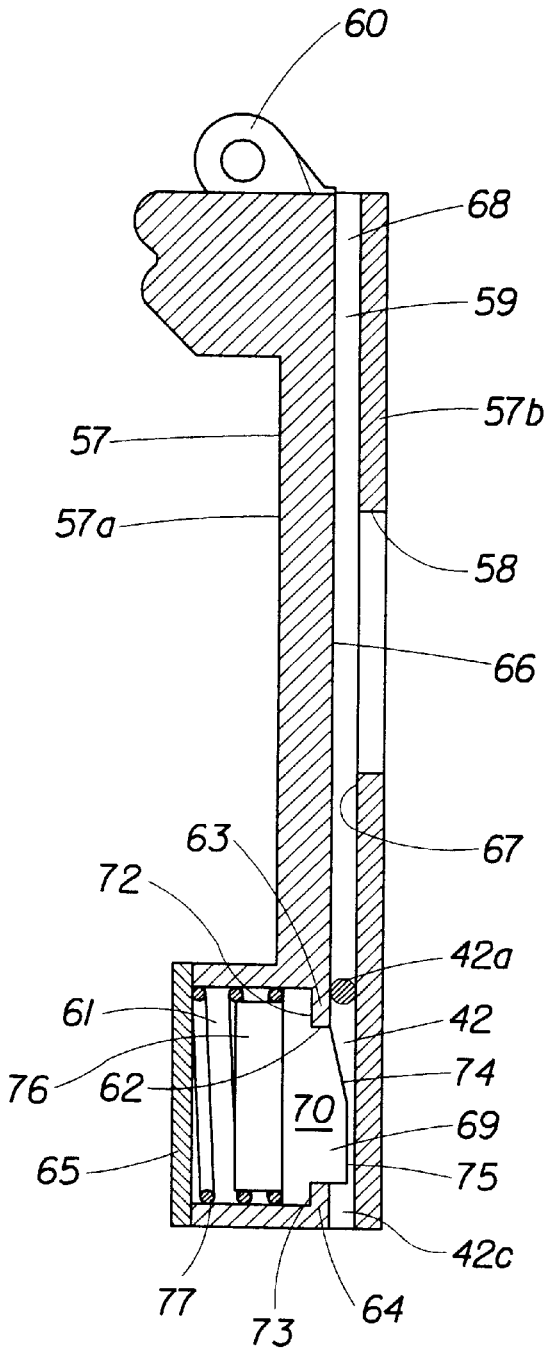
FIG. 12 is a cross-sectional view similar to FIG. 10, but illustrating another embodiment of an anti-buckle device in its extended position.

In FIG. 12 a guide body 57 is shown, generally similar to guide body 4 of FIG. 10. The guide body has a forward portion 57*a* and a rearward portion 57*b*. The portion 57*b* has an opening 58 therein through which staples pass from the magazine 6 (not shown in FIG. 12) to the guide track 59.

The forward portion 57*a* may be provided at its upper end with a pair of bifurcations, one of which is shown at 60. These bifurcations are equivalent to bifurcations 55 and 56 of FIG. 9 and serve the same purpose. At its lower end, the forward portion 57*a* has a hollow chamber 61. Chamber 61 communicates with drive track 59 through an opening 62. Opening 62 is slightly smaller than the inside vertical dimension of chamber 61 creating retaining tabs 63 and 64, the purpose of which will be apparent hereinafter. The opposite end of chamber 61 is closed by removable plate 65.

As viewed in FIG. 12, the drive track 59 has a forward vertical surface 66 constituting the rear surface of guide body forward portion 57*a*, a rear surface 67 constituting the forward surface of the rearward portion 57*b* of the guide body 57 and side walls, one of which is shown at 68. The side walls may constitute an integral, one-piece part of either the forward guide body portion 57*a* or the rearward guide body portion 57*b*.

The guide body 57 of FIG. 12 is completed by the provision of a plunger 69. Plunger 69 has a main body portion 70 which just nicely fits within chamber 61 and is slidable therein. The main body 70 has a nose portion 71 which extends through opening 62 into drive tract 59. The difference in size between the nose portion 71 and the main body portion 70 forms abutment surfaces 72 and 73 which cooperate with retainer portions 63 and 64 to determine the depth to which the nose 71 extends into drive track 57. The nose 71 has an inwardly and downwardly sloping surface 74 which is equivalent to portion 54*d* of spring 54 of FIG. 10. Nose 71 has a vertical surface 75 equivalent to the portion 54*e* of spring 54 of FIG. 10. It will be noted that the surface 75 lies adjacent the rear surface 67 of drive track 59.

Plunger 69 has a spring seat portion 76 extending from the opposite side of main body portion 70 as does nose portion 71. The spring seat 76 has a circular periphery and is adapted to receive the compression spring 77. One end of compression spring 77 abuts the main body portion 70 of plunger 69. The other end of compression spring 77 abuts the removable plate 65. Spring 77 serves to maintain the nose 71 of plunger 69 in the position shown in FIG. 12. The nose portion 71 is of a width to be just nicely received between the legs of staple 42. Only one leg 42*c* is shown in FIG. 12.

Figure 13:
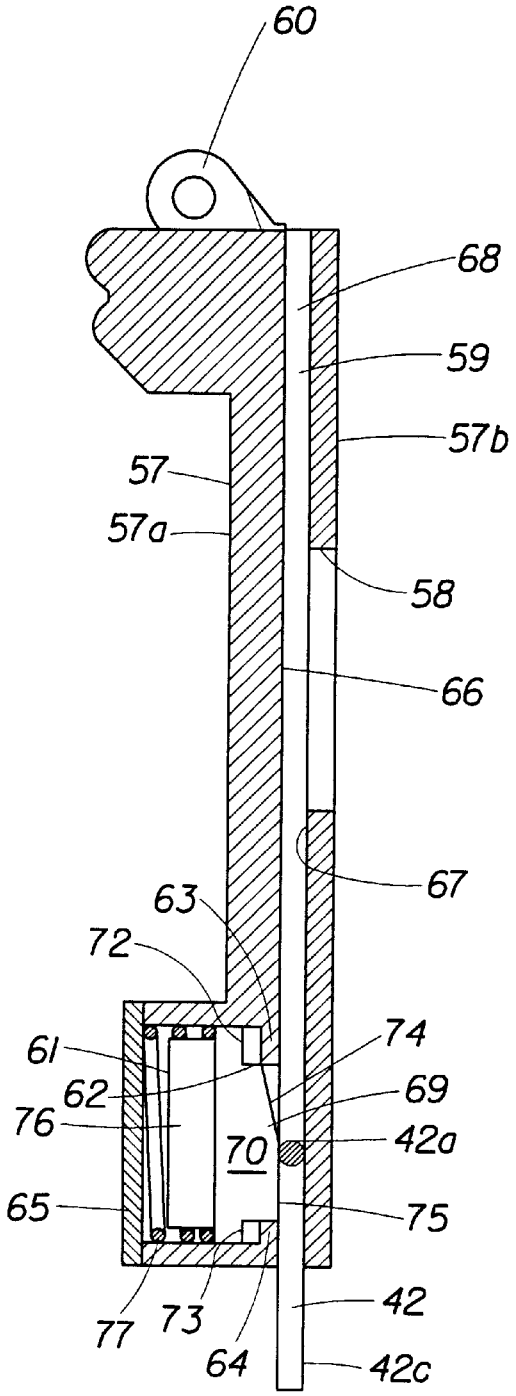
FIG. 13 is a cross-sectional view similar to FIG. 12 and illustrating the anti-buckle device in its retracted position.

The forwardmost staple 42 of a stick of staples (not shown) will be located in drive track 59 by the staple advancing mechanism of magazine 6. The tool driver (not shown) will strip the forwardmost staple from its stick and will drive the staple downwardly within drive track 59. As the staple approaches the bottom of drive track 59, its legs will straddle plunger nose 71. The nose 71 will be located between the legs at the time the staple is at the bottommost end of the drive track and in contact with the steel workpieces to be joined. As the driver drives the staple legs through the workpieces, it will be prevented from buckling by the forward surface 66 of the drive track, the rearward surface 67 of the drive track, and the drive track sides, one of which is shown at 68. The legs cannot buckle toward each other due to the presence therebetween of the plunger nose 71. Immediately after the penetration of the steel workpieces by the staple legs, the crown 42*a* of the staple will engage nose surface 74. Nose surface 74 acts as a cam surface which cooperates with the staple crown and the staple driver to shift the nose portion out of drive track 59 and into its retracted position illustrated in FIG. 13, wherein like parts have been given like index numerals. Once the staple 42 is fully driven and clinched with respect to the workpieces, the driver will return to its retracted position allowing the plunger nose 71 to regain the position shown in FIG. 12, by virtue of compression spring 77. Thus, when a staple is fully driven and clinched, the tool will be immediately ready for the next staple driving cycle.

Modifications may be made in the invention without departing from the spirit of it. For example, details of the present invention may be applied to electric staple driving tools, as well as pneumatic staple driving tools. The prior art has devised a number of electric staple driving tools employing a solenoid as the driving force, or a flywheel. In such an instance, it would be within the scope of the invention to consider element 16 of FIG. 1 a solenoid, and element 35 an electric switch to energize said solenoid. The electric switch, itself, may be switched between an "on" state and an "off" state by one of the safety and the manual trigger.

What is claimed:

1. A staple driving tool for stapling together two or more light gauge steel workpieces, said staple driving tool comprising a handle portion, a main body portion, a driver in said main body portion, a guide body beneath said main body portion having a bottom end and a drive track for said driver, a magazine containing a row of staples and being connected to said drive track, a staple advancing mechanism urging the forwardmost staple of said row into said drive track beneath said driver, a tool actuating trigger, and a safety, said safety being adapted to enable said trigger when said safety is pressed against a workpiece, a jaw assembly supporting an anvil, said jaw assembly being adapted to be selectably pivotable between a normal open position and a closed position wherein said steel workpieces to be joined are clamped between said anvil and said guide body bottom end prior to stapling, each staple of said row comprising a U-shaped staple having a pair of legs in parallel spaced relationship and connected by a crown, a member shiftable between a normal extended position across the lower portion of said drive track and a retracted position out of said drive track, such that during a stapling operation the forwardmost staple of said row approaches said steel workpieces under the urging of said driver and said staple legs straddle said member to prevent buckling of said legs tower each other until they have penetrated said steel workpieces, said drive track having walls precluding buckling of said staple legs in other directions, said member being so configured that it is shifted to said retracted position by said crown and driver enabling said driver and anvil to fully clinch said staple, said anvil comprising a top surface, a rectangular recessed staple-forming pocket located in said top surface of said anvil, said pocket having parallel end walls and parallel side walls extending perpendicularly from said anvil surface and a bottom surface curved between said pocket end walls, said pocket being skewed with respect to said anvil surface such that said pocket sides lie at an angle to the crown of a staple being formed therein, whereby said staple legs during clinching are bent curvalinearly by said curved pocket bottom toward said workpieces being joined and said staple legs are formed at an angle to said staple crown and are parallel to each other.

2. The structure claimed in claim 1 including a mounting bar affixed to and beneath said magazine, said jaw assembly being pivotally affixed to said mounting bar, tool actuated mechanism for pivoting said jaw between said open and clamping positions being affixed to said mounting bar, said mechanism for pivoting said jaw after clamping said workpieces and before said stapling operation being releasable and reclampable to enable realignment of said workpieces if required.

3. The structure claimed in claim 1 wherein said staple driving tool comprises a pneumatic staple driving tool, a mounting bar affixed to and beneath said magazine, said jaw assembly being pivotally affixed to said mounting bar, a toggle assembly being pivotally affixed to said mounting bar, said toggle assembly being joined to said jaw assembly by a link having a first end pivoted to said jaw assembly and a second end pivoted to said toggle assembly, an air actuated cylinder pivotally affixed to said mounting bar, said cylinder having a piston and a piston rod, said piston rod having a free end pivoted to said toggle assembly, said piston rod being shiftable to an extended position when said cylinder is connected to a source of pressurized air causing said jaw to assume its clamping position via said toggle assembly and said link, said piston being shiftable to a normal retracted position within said cylinder when said cylinder is connected to atmosphere causing said jaw to assume its open position via said toggle assembly and said link, a valve connected to said cylinder, said valve being shiftable between a normal position wherein it connects said cylinder to atmosphere and an actuated position wherein it connects said cylinder to said air under pressure.

4. The structure claimed in claim 3 wherein said valve is biased to said normal position and is shiftable to said actuated position by partial actuation of said tool trigger, said tool trigger being connected with said valve by a lateral extension, whereby partial actuation of said tool trigger will clamp said workpieces between said anvil and said guide body bottom end, thereafter complete actuation of said trigger will initiate and complete a staple driving operation, release of the fully actuated trigger will unclamp said stapled workpieces, and release of said partially actuated tool trigger will unclamp said workpieces enabling realignment and repositioning thereof.

5. The structure claimed in claim 3 wherein said valve is biased to said normal position and is shiftable to said actuated position by said safety.

6. The structure claimed in claim 1 wherein said staple driving tool comprises an electric staple driving tool, a mounting bar affixed to and beneath said magazine, said jaw assembly being pivotally affixed to said mounting bar, a toggle assembly being pivotally affixed to said mounting bar, said toggle assembly being joined to said jaw assembly by a link having a first end pivoted to said jaw assembly and a second end pivoted to said toggle assembly, a solenoid pivotally affixed to said mounting bar, said solenoid having a plunger pivotally attached to said toggle assembly, said solenoid when actuated shifting said jaw to said clamping position via said link said toggle assembly and said plunger, said solenoid being adapted to be actuated and deactuated by an on-off switch.

7. The structure in claim 1 wherein said angle of said staple legs to said staple crown lies within the range of from about 10° to about 30°.

8. The structure claimed in claim 1 wherein said drive track of said guide body is defined by a rear wall having an opening therein for the passage of said forwardmost staple from said magazine into said drive track, a pair of side walls and a front wall with a recessed central portion extending at least a part of the length of said front wall from said guide body bottom end, said recessed central portion of said front wall being flanked by coplanar surfaces along which said legs of said forwardmost staple slide during a staple driving operation, and elongated leaf spring having an upper end affixed to the outside surface of said front wall near the upper end thereof, said leaf spring having a first portion normally parallel said outside surface of said guide body front wall, a second portion sloping downwardly and rearwardly and passing through a slotted opening in said front wall located in said recessed central portion thereof, a third portion normally coplanar with said flanking surfaces of said front wall, a fourth cam portion normally sloping downwardly and rearwardly partway across said drive track and terminating in a fifth portion normally parallel to said rear wall of said drive track and normally centered in said drive track, at least said fourth and fifth leaf spring portions having a width to be just nicely received between said legs of said forwardmost staple driving a staple drive operation, said fourth and fifth portions of said leaf spring being so positioned as to be contacted first by said staple crown and thereafter by said driver to shift said fourth and fifth leaf spring portions out of said drive track after said staple has penetrated said workpieces to allow said staple to be fully clinched, said fifth portion of said leaf spring precluding buckling of said staple legs toward each other as they contact and penetrate said workpieces, said rear wall, side walls and said front wall flanking surfaces preventing buckling of said staple legs in forward, rearward and laterally outward directions.

9. The structure claimed in claim 1 wherein said drive track of said guide body is defined by a rear wall having an opening therein for passage of said forwardmost staple from said magazine into said drive track, a pair of side walls and a front wall, said front wall near said bottom end thereof having a longitudinal slot sized to receive the nose of a plunger, said plunger being spring biased to a normal extended position within said drive track, said plunger nose having a downwardly and rearwardly sloping top cam surface, a rearward surface parallel to said rear drive track wall and adjacent said rear wall when said plunger is in said extended position and sides parallel to said drive track side walls, said plunger having a width such that said plunger sides are just received between said legs of said forwardmost staple during a staple driving operation, said plunger and its top cam surface being so positioned within said drive track as to be contacted first by said staple crown and thereafter by said driver to shift said plunger to a retracted position out of said drive track after said staple has penetrated said workpieces to allow said staple to be fully clinched, said plunger in its normal position preventing buckling of said staple legs toward each other as they contact and penetrate said workpieces, said rear wall, said side walls and said front wall of said drive track preventing buckling of said staple legs in forward, rearward and laterally outward directions.

10. A mounting bar and anvil bearing jaw assembly for use with a staple driving tool for stapling workpieces together, said staple driving tool being of the type having a guide body with a bottom end, a drive track in said guide body, a driver shiftable in said drive track, a magazine, a tool actuating trigger and a safety, said safety being adapted to enable said trigger when said safety is pressed against a workpiece, said mounting bar being affixed to said tool beneath said magazine, said jaw assembly being pivotally affixed on said mounting bar and being pivotable between a normal open position and a clamping position for clamping workpieces between said anvil and said guide body bottom end, and a mechanism for shifting said jaw and anvil assembly between said open and clamping positions, said anvil comprising a top surface, a rectangular recessed staple-forming pocket located in said top surface of said anvil, said pocket having parallel end walls and parallel side walls extending perpendicularly from said anvil surface and a bottom surface curved between said pocket end walls, said pocket being skewed with respect to said anvil surface such that said pocket sides lie at an angle to the crown of a staple being formed therein, whereby said staple legs during clinching are bent curvalinearly by said curved pocket bottom toward said workpieces being joined and said staple legs are formed at an angle to said staple crown and are parallel to each other.

11. The structure claimed in claim 10 wherein said staple driving tool comprises a pneumatic tool, said jaw shifting mechanism comprising a link pivotally affixed to said jaw assembly, a toggle assembly pivotally attached to said mounting bar, said link being pivotally attached to said toggle assembly and an air cylinder pivotally affixed to said mounting bar, said cylinder having a piston and piston rod, said piston rod being pivotally attached to said toggle mechanism, said cylinder being attached to an air valve, said air valve normally connecting said air cylinder to atmosphere maintaining said jaw assembly in its normal open position, said air valve being shiftable by one of said trigger and said safety to connect said cylinder to air under pressure and shift said jaw assembly to said clamping position via said link, said toggle and said piston rod.

12. The structure claimed in claim 10 wherein said staple driving tool is an electric tool, said jaw shifting mechanism comprising a link pivotally affixed to said jaw assembly, a toggle assembly pivotally attached to said mounting bar, said link being pivotally attached to said toggle assembly and a solenoid pivotally attached to said mounting bar, said solenoid having a plunger pivotally affixed to said toggle mechanism, said solenoid being adapted to be energized and shift said jaw assembly to its clamping position via said link, said toggle assembly and said solenoid plunger.

13. A method of stapling together at least two workpieces of light gauge steel including the steps of providing a staple driving tool of the type having a guide body with a free end, a driver, a drive track in said guide body for said driver, a magazine connected to said drive track and a row of staples in said magazine, pivotally mounting on said tool an anvil supporting jaw shiftable between a normal open position and a clamping position wherein said anvil is located adjacent said guide body free end, said anvil comprising a top surface, a rectangular recessed staple-forming pocket located in said top surface of said anvil, said pocket having parallel end walls and parallel side walls extending perpendicularly from said anvil surface and a bottom surface curved between said pocket end walls, said pocket being skewed with respect to said anvil surface such that said pocket sides lie at an angle to the crown of a staple being formed therein, whereby said staple legs during clinching are bent curvalinearly by said curved pocket bottom toward said workpieces being joined and said staple legs are formed at an angle to said staple crown and are parallel to each other arranging said workpieces in proper position with respect to each other and said guide body, shifting said jaw to its clamping position, clamping said workpieces between said anvil and said guide body free end, actuating said tool to staple said workpieces together and releasing said jaw to its normal open position.

14. A method of stapling together at least two workpieces of light gauge steel including the steps of providing a staple driving tool of the type having a guide body with a free end, a driver, a drive track in said guide body for said driver and defined by front, rear and side walls, a magazine connected to said drive track, and a row of staples in said magazine each comprising a pair of legs and a crown, providing an aperture in one of said front and rear drive track walls, providing a member shiftable within said aperture between an extended position wherein a part of said member is located within said drive track and a retracted position wherein said part of said members outside said drive track, biasing said member to said extended position, sizing said member such that said part thereof is of a width approximating the distance between the legs of a staple and providing said member part with a cam surface, aligning said workpieces to be joined, actuating said tool to cause said driver to drive a staple, causing said staple legs to straddle said member part until said legs have penetrated said workpieces to prevent buckling of said legs toward each other, causing said staple crown to thereafter engage said member cam surface to shift said member to said retracted position, and clinching said staple.

15. A method of stapling together at least two workpieces of light gauge steel including the steps of providing a staple driving tool of the type having a guide body with a free end, a driver, a drive track in said guide body for said driver defined by front, rear and side walls, a magazine connected to said drive track, and a row of staples in said magazine each comprising a pair of legs and a crown, pivotally mounting on said tool an anvil supporting jaw shiftable between a normal open position and a clamping position wherein said anvil is located adjacent said guide body free end, providing an aperture in one of said front and rear drive track walls, providing a member shiftable within said aperture between an extended position wherein a part of said member is located within said drive track and a retracted position wherein said part of said member is outside said drive track, biasing said member to said extended position, sizing said member such that said part thereof is of a width approximating the distance between the legs of a staple, providing said member part with a cam surface, arranging said workpieces in proper position to be stapled, clamping said workpieces between said anvil and said guide body free end, actuating said tool to cause said driver to drive a staple, causing said staple legs to straddle said member part until said legs have penetrated said workpieces to prevent buckling of said staple legs toward each other, causing said staple crown to thereafter engage said member cam surface to shift said member to said retracted position, clinching said staple and releasing said jaw to its normal open position.

* * * * *